US007006640B2

(12) United States Patent
Arai et al.

(10) Patent No.: US 7,006,640 B2
(45) Date of Patent: Feb. 28, 2006

(54) SPEAKER

(75) Inventors: Daisuke Arai, Tokyo (JP); Susumu Fujiwara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 46 days.

(21) Appl. No.: 10/689,614

(22) Filed: Oct. 22, 2003

(65) Prior Publication Data

US 2004/0151339 A1 Aug. 5, 2004

(30) Foreign Application Priority Data

Jan. 30, 2003 (JP) ..... 2003-022417

(51) Int. Cl.
*H04R 25/00* (2006.01)

(52) U.S. Cl. ..... 381/96; 381/190; 381/397

(58) Field of Classification Search ..... 381/113, 381/114, 116, 190–191, 396–397, 412, 419, 381/420, 421–422, 407, 96, 118
See application file for complete search history.

(56) References Cited

U.S. PATENT DOCUMENTS 3,941,932 A * 3/1976 D'Hoogh ..... 381/96
4,276,443 A * 6/1981 Meyers ..... 381/96
4,414,436 A * 11/1983 Sashida et al. ..... 381/152
4,475,014 A * 10/1984 King ..... 381/190
4,550,430 A * 10/1985 Meyers ..... 381/96
4,607,382 A * 8/1986 Dijkstra et al. ..... 381/59
4,821,328 A * 4/1989 Drozdowski ..... 381/96
5,461,676 A * 10/1995 Hobelsberger ..... 381/96
5,629,987 A * 5/1997 Hobelsberger ..... 381/96
6,343,128 B1 * 1/2002 Coffin ..... 381/186
6,408,078 B1 * 6/2002 Hobelsberger ..... 381/96
6,839,445 B1 * 1/2005 Kihara ..... 381/190

FOREIGN PATENT DOCUMENTS

JP 57-119596 A 7/1982
JP 63092200 A 4/1988
JP 05-030596 * 2/1993

* cited by examiner

*Primary Examiner*—Sinh Tran
*Assistant Examiner*—Phylesha Dabney
(74) *Attorney, Agent, or Firm*—Birch, Stewart, Kolasch & Birch, LLP

(57) ABSTRACT

A pole piece 19 of a speaker main unit 1 has a pole 19*a* engaged with a bobbin 14 from the back side of a diaphragm 12, and a flange 19*b* horizontally expanding from the base of the pole 19*a*. In the pole 19*a* is formed a through hole 19*c* passing therethrough in an axial direction thereof, and in the bottom end of the through hole 19*c* is provided with a taper 19*d* which widens with it goes downward. A thin film piezoelectric element 4 is provided such that the element covers an external opening 19*e* of the through hole 19*c*, and one end 4*a* of a thin film piezoelectric element 4 is adhered to the bottom surface of the flange 19*b*.

5 Claims, 4 Drawing Sheets

SPEAKER

This nonprovisional application claims priority under 35 U.S.C. §119(a) on Patent Application No. 2003-022417 filed in JAPAN on Jan. 30, 2003, which is herein incorporated by reference.

BACKGROUND OF THE INVENTION

1. Field of the Invention

The present invention relates to a speaker, and more particularly, to a speaker of a motional-feedback type, which detects vibrations of a vibration system and feeds back a detection signal to a drive system.

2. Description of the Related Art

Reproduction capability of a low-pitched frequency sound of a typical speaker greatly depends on the lowest resonance frequency specific to the speaker. For instance, as an area of a diaphragm increases, the lowest resonance frequency decreases by contrary, thus leading to improvement in the reproduction capability of a low-pitched frequency sound. However, an increase of its diaphragm size results in not only an increase in the overall dimension of the speaker but also a gain of weight of the diaphragm, which lowers efficiency of the speaker. In order to solve such problems, a speaker has been developed, in which the so-called motional feedback (MFB) is adopted for detecting amplitude of a diaphragm and feeding back a detection signal to an input signal.

The speaker adopted the MFB, in which a tabular piezoelectric element is provided on the top of a voice coil bobbin through a supporting member. In this case, the voice coil bobbin is driven by a signal input to a voice coil, the diaphragm vibrates by the aid of vibrations of the bobbin, thereby producing a sound. Simultaneously, the tabular piezoelectric element also vibrates through the supporting member, and an output detected being obtained depending on how much the diaphragm vibrates. Alternatively, a top plate is fitted on the top of the voice coil bobbin, a supporter is stood up on the center of the top plate, and the center of the tabular piezoelectric element is adhered on the top of the supporter. In addition, this tabular piezoelectric element is supported only by the supporter serving as a supporting member.

As an example, see Japanese Patent Publication Laid-Open No. 57-119596 (Page 2, Col Upper Left, Lines 5–11, Col Upper Right, line 17 to Col Lower left, line 1. FIG. 2 and FIG. 5).

The conventional speaker adopted the motional feedback has, on one hand that, the advantage that reproduction capability of a low-pitched frequency sound can be improved by electrically compensating the lowest resonance frequency without inviting an increase in its diaphragm size. The speaker has, on the other hand, the disadvantage that efficiency of the speaker lowers because weights of the top plate, supporting member (supporter), and tabular piezoelectric element are collectively applied to the diaphragm, which gains the weight of the vibration system. Moreover, the speaker also has the disadvantage that it shows poor workability on production as the tabular piezoelectric element is installed on the diaphragm through the top plate and the supporting member (supporter). In addition, the speaker also has the disadvantage that it presents low maintainability since the tabular piezoelectric element has been integrally combined with the diaphragm, resulting in the shortcoming that the diaphragm is under the pressure of necessity to have to replace the diaphragm as well with new one, when the tabular piezoelectric element gets out of order.

SUMMARY OF THE INVENTION

The present invention has been made to solve the above-mentioned problems. An object of the present invention is to provide a speaker adopted the motional feedback that is able to lose weight of a vibration system, as well as improves workability on production and maintainability.

The speaker according to the present invention includes a pole piece having a pole engaged with a bobbin behind a diaphragm; a through hole passing through the pole in an axial direction thereof; and a thin film piezoelectric element provided over an external opening of a through hole such that the element detects vibrations of the diaphragm by a change in pressure within the through hole.

As mentioned above, according to the present invention, provision of the pole piece having the through hole passing therethrough in an axial direction thereof as well as adhesion of a thin film piezoelectric element on the external opening of the through hole loses the weight of the vibration system of the speaker, thus improving efficiency of the speaker. Moreover, there being provided the thin film piezoelectric element outside the pole piece, workability con production an be improved. Furthermore, there having been no thin film piezoelectric element within the diaphragm, it eliminates the need for replacement of the diaphragm when the thin film piezoelectric element gets out of order, which improve maintainability thereof.

DETAILED DESCRIPTION OF THE PREFERRED EMBODIMENTS

First Embodiment

Figure 1:
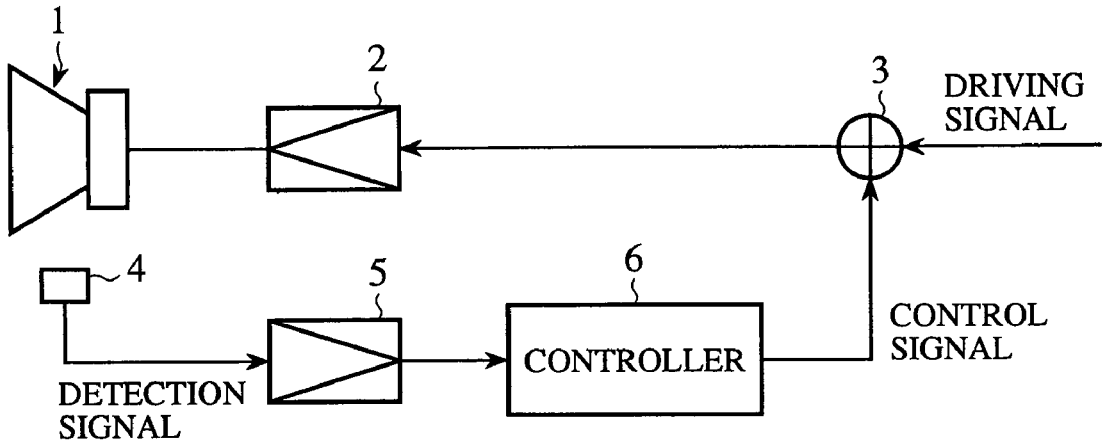
FIG. 1 is a block diagram of the speaker according to a first embodiment of the present invention.

FIG. 1 is a block diagram of the speaker according to the first embodiment of the present invention.

In FIG. 1, a mixer 3 is connected to a speaker main unit 1 through a first amplifier 2, and a driving signal is input to this mixer 3. Furthermore, in the speaker main unit 1 is provided with a thin-film piezoelectric element 4 of a thin type or in the form of thin film. A detection signal output from the thin film piezoelectric element 4 is input to a controller 6 through a second amplifier 5, and a control signal output from the controller 6 is input to the mixer 3.

Figure 2:
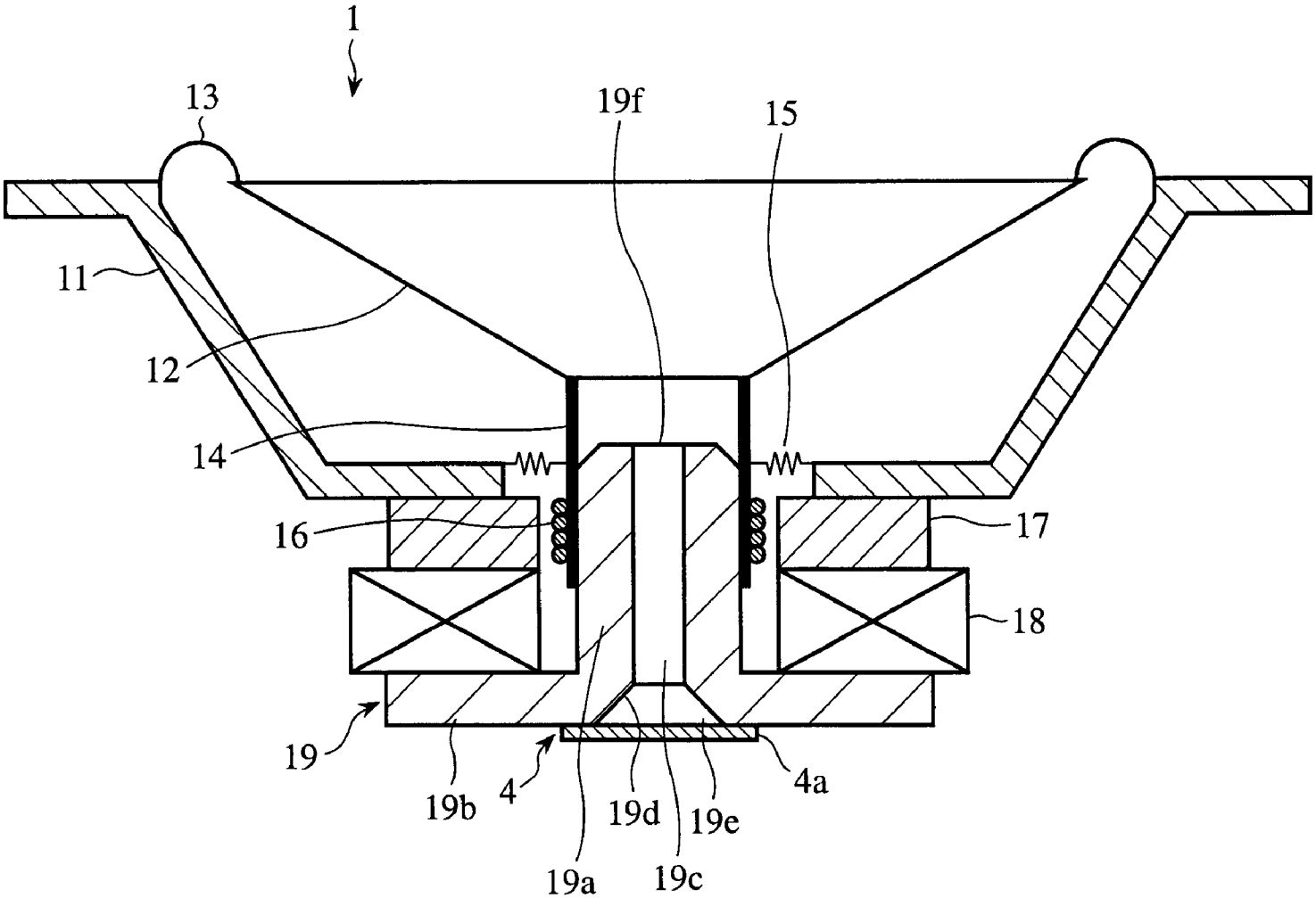
FIG. 2 is a sectional view of the speaker main unit in the speaker according to the first embodiment.

FIG. 2 is a sectional view of the speaker main unit 1.

In FIG. 2, a diaphragm 12 is disposed within a frame 11 of the speaker main unit 1, and the top end of the diaphragm 12 is connected with the top end of the frame 11 through an edge 13. A bobbin 14 is perpendicularly provided on the back of the diaphragm 12, and a spider 15 is interposed between the frame 11 and the bobbin 14. A vibration system consists of the diaphragm 12, the edge 13, and the bobbin 14.

A voice coil 16 is wound around a peripheral surface of the bobbin 14, and the voice coil 16 is connected with the first amplifier 2. Mounted in order beneath the frame 11 are a plate 17 and a magnet 18, and the plate 17 and the magnet 18 are supported by a pole piece 19. A magnetic circuit consists of the plates 17, the magnets 18, and the pole piece 19. A drive system consists of the magnetic circuit, the voice coil 16, and the first amplifier.

The pole piece 19 has a pole 19*a* engaged with the bobbin 14 and a flange 19*b* horizontally extending from the base of the pole 19*a* and supporting the magnet 18. Furthermore, the pole 19*a* has a through hole 19*c* passing therethrough in an axial direction thereof. Moreover, the through hole 19*c* has a taper 19*d* which widens an external opening of the through hole with it goes outward. Therefore, the external opening 19*e* of the through hole 19*c* has an internal diameter larger than that of the through hole.

Figure 3:
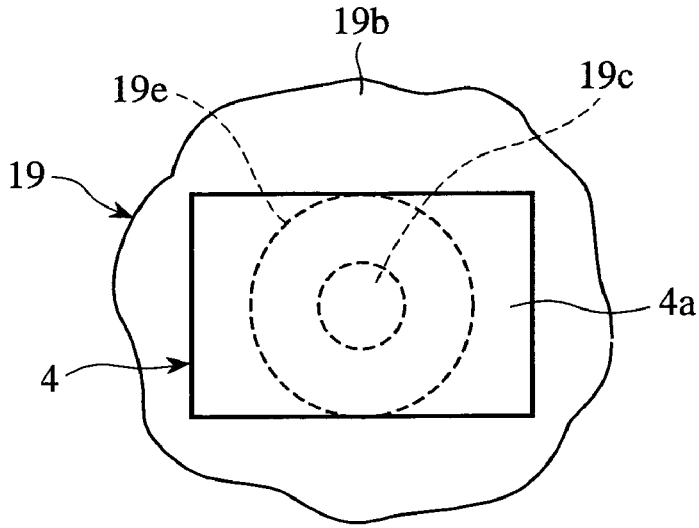
FIG. 3 is a partially enlarged bottom view of the pole piece, on which the thin film piezoelectric element is provided, of the speaker according to the first embodiment.

The thin film piezoelectric element 4 is formed of piezoelectric ceramic such as PZT (plumbum zirconate titanate), and has a rectangular geometry. The thin film piezoelectric element 4 is provided over the external opening 19*e* of the pole piece 19. That is, FIG. 3 is a partially enlarged bottom view of the pole piece 19 to which the thin film piezoelectric element 4 is adhered. The thin film piezoelectric element 4 is provided such that the element covers the external opening 19*e* of the pole piece 19, and one end 4*a* of the thin film piezoelectric element 4 is adhered to the bottom surface of the flange 19*b* of the pole piece 19.

In the speaker having such a configuration, a driving signal is input to the first amplifier 2 through the mixer 3, amplified therein, and input to the voice coil 16. Thereby, the bobbin 14 integrally combined with the voice coil 16 vibrates and, at the same time the diaphragm 12 integrally combined with the bobbin 14 vibrates. When the diaphragm 12 vibrates, the pole 19*a* of the pole piece 19 performs, viewing relatively, a reciprocating motion within the bobbin 14, and thereby back pressure of the diaphragm 12 comes in and out of the external opening 19*e* of the pole piece 19. In other words, air containing acoustic signal components comes in and out of the external opening 19*e*.

Figure 4:
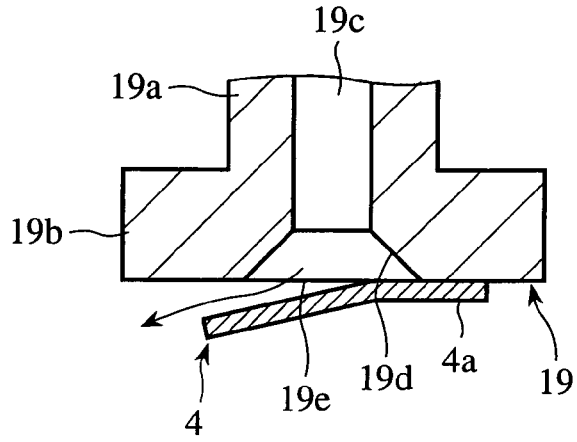
FIG. 4 is an explanatory diagram of the operation of the thin film piezoelectric element of the speaker according to the first embodiment.
Figure 5:
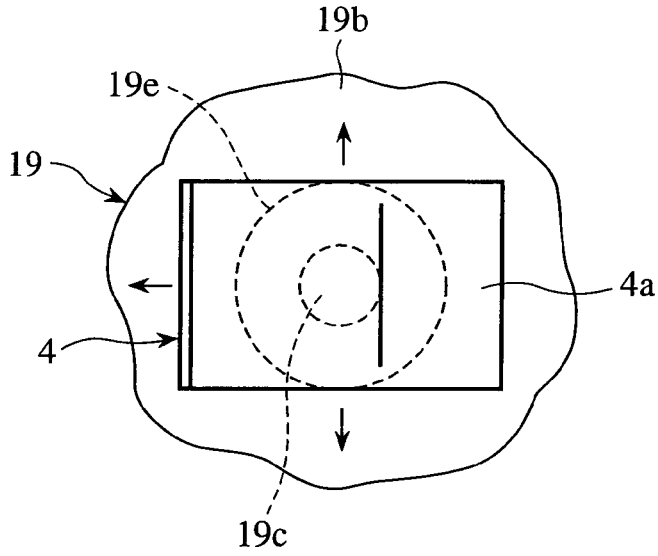
FIG. 5 is an explanatory diagram of the operation of the thin film piezoelectric element of the speaker according to the first embodiment.

When air flows in a direction of an arrow as shown in FIG. 4 and FIG. 5, the thin film piezoelectric element 4 is deformed. Thereby, a potential difference is occurred in the thin film piezoelectric element 4, and the thin film piezoelectric element 4 captures an acoustic signal as an electric signal and outputs a detection signal. This detection signal is amplified by the second amplifier 5, and then input to the controller 6. The controller 6 feeds back the signal as a control signal to the mixer 3 for compensation of the driving signal with advantageously reproduced the low-pitched frequency sound.

In the first embodiment, the provision of the thin film piezoelectric element 4 not in the diaphragm 12 but in the pole piece 19 loses the weight of the vibration system, and improves the intrinsic efficiency of the diaphragm 12. Moreover, the provision of the thin film piezoelectric element 4 on the outside of the pole piece 19 by adhering one end 4*a* of the element thereto with such adhering members as adhesive and screws dispenses with the conventional top plate or supporting member (supporter). This contributes to improvement in the workability on production. In addition, the thin film piezoelectric element 4 has been permitted to replace with new one when the element suffers from damage, this eliminates inconvenience attendant with the conventional replacement work that the diaphragm 12 should be replaced as well, thereby improving the maintainability of the speaker.

Moreover, the detection of the vibrations of the diaphragm 12 by the thin film piezoelectric element 4 generates a detection signal having excellent frequency properties and linearity. Furthermore, since the internal diameter of the external opening 19*e* of the pole piece 19 is larger than that of the internal opening 19*f*, it is possible to cause air to act on the thin film piezoelectric element 4 over the larger area. This generates the excellent detection signal.

Second Embodiment

Figure 6:
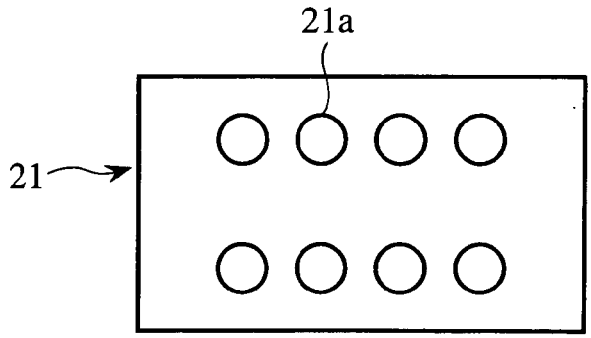
FIG. 6 is a plan view of the thin film piezoelectric element of the speaker having a plurality of holes thereon according to a second embodiment of the present invention.

In the first embodiment, since the thin film piezoelectric element 4 is provided such that the element covers the external opening 19*e* of the pole piece 19, there may be a case where it could be difficult to allow the back pressure of the diaphragm 12 to escape from the external opening 19*e*. To avoid such difficulty, in the second embodiment, the thin film piezoelectric element 21 having two or more holes 21*a* passing therethrough is provided, as shown in FIG. 6, instead of the thin film piezoelectric element 4 in the first embodiment in order to make easy for the back pressure of the diaphragm 12 to escape from the external opening 19*e*. At this time, the shapes, areas, and locations, etc. of the holes 21*a* are adjusted for tuning sensitivity of the thin film piezoelectric element 21.

The second embodiment allows detection of the acoustic signal while having escaping the back pressure of the diaphragm 12 from those holes 21*a* formed therein by the virtue of the thin film piezoelectric element 21 having one or more holes 21*a*. Moreover, the adjustment of the shapes, areas, and locations, etc. of the holes 21 for tuning sensitivity of the thin film piezoelectric element 21 enables tuning of the sound quality, thereby achieving a speaker having excellent performance.

Third Embodiment

Figure 7:
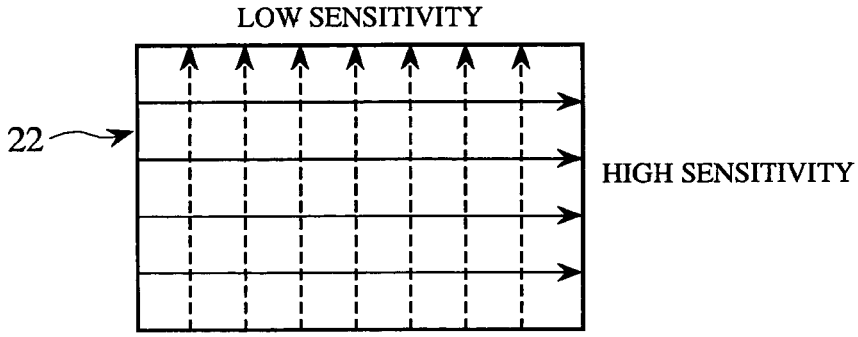
FIG. 7 is a diagram of explaining how sensitivity of the thin film piezoelectric element changes with respect to directions of the element of the speaker according to a third embodiment of the present invention.
Figure 8:
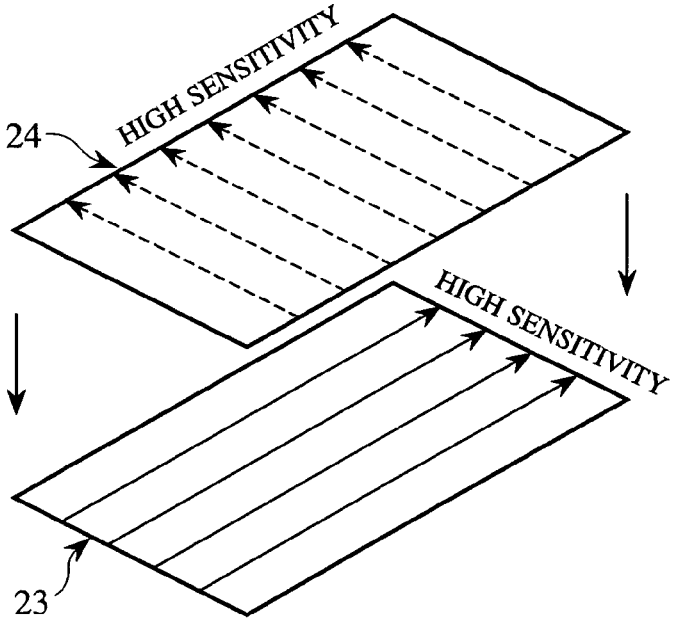
FIG. 8 is an explanatory view of a state where two thin film piezoelectric elements of the speaker according to a third embodiment of the present invention are not yet adhered together.

As shown in FIG. 7, a common thin film piezoelectric element 22 has directionality attributable to its crystal orientation. For this reason, the thin film piezoelectric element 22 of this kind detects a signal having a different level depending on which of directions the element expands or contracts, so that the element is undesirable as an element that detects a flow of air going in and out of the external opening 19*e* of the pole piece 19. In the third embodiment, in order to solve such a problem, one thin film piezoelectric element 24 having high sensitivity in a transverse direction is stacked, as shown in FIG. 8, over the other thin film piezoelectric element 23 having high sensitivity in a longitudinal direction to alleviate a difference in sensitivity caused by their directions. Accordingly, the third embodiment offers a desirable detection signal by the grace of the two stacked thin films piezoelectric elements 23 and 24.

Fourth Embodiment

Figure 9:
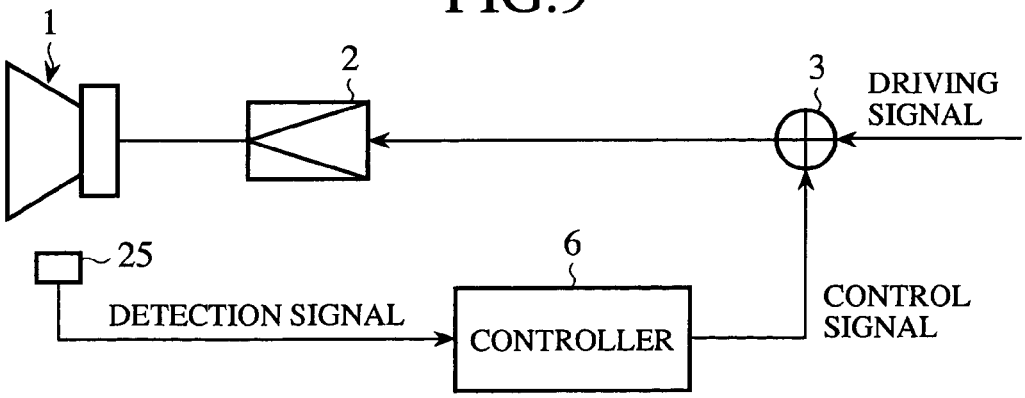
FIG. 9 is a block diagram of the speaker according to a fourth embodiment.

In the first embodiment, although piezoelectric ceramic such as PZT (plumbum zirconate titanate) has been used as the thin film piezoelectric element 4, addition of the second amplifier 5 for amplifying an detection signal is essential because of a low-level sensitivity of the detection signal of PZT. Instead, in the fourth embodiment, PVDF (polyvinylidene fluoride) of the high level of a detection signal, called under an alias of a piezoelectric polymer, is used, as shown in FIG. 9, as a thin film piezoelectric element 25, which eliminates the second amplifier 5 indispensable in the first embodiment. Accordingly, the fourth embodiment offers an entirely simplified configuration.

While descriptions are made in the above embodiments as to the configuration where the speaker adopted the motional feedback consists of the speaker main unit 1, the first amplifier 2, the mixer 3, the second amplifier 5, the thin film piezoelectric element 4, and the controller 6, the present invention is not necessarily limited to this configuration. Moreover, needless to say, the thin film piezoelectric element may have such a geometry as square or circular, though the thin film piezoelectric elements 4, 21, 23, 24, and 25 each has a rectangular one in the above embodiments.

What is claimed is:

1. A speaker comprising:

a pole piece having a pole engaged with a bobbin behind a diaphragm;

a through hole passing through the pole in an axial direction thereof; and a thin film piezoelectric element provided over an external opening of the through hole such that the element detects vibrations of the diaphragm by a change in pressure within the through hole.

2. The speaker according to claim 1, wherein the through hole has an external opening which widens at an outer end.

3. The speaker according to claim 1, wherein the thin film piezoelectric element has one or more holes passing therethrough.

4. The speaker according to claim 1, wherein the thin film piezoelectric element constructed by two thin film piezoelectric elements whose direction representative of high sensitivity intersect each other.

5. The speaker according to claim 1, wherein the thin film piezoelectric element is formed of polyvinylidene fluoride.

* * * * *